United States Patent [19]

Cram et al.

[11] 4,114,690

[45] Sep. 19, 1978

[54] LOW-TEMPERATURE OXIDATION METHOD FOR THE RECOVERY OF HEAVY OILS AND BITUMEN

[75] Inventors: Phillip J. Cram, Calgary; David A. Redford, Fort Saskatchewan, both of Canada

[73] Assignee: Texaco Exploration Canada Ltd., Calgary, Canada

[21] Appl. No.: 804,129

[22] Filed: Jun. 6, 1977

[51] Int. Cl.[2] ..... E21B 43/24

[52] U.S. Cl. ..... 166/261; 166/272

[58] Field of Search ..... 166/261, 256, 251, 272

[56] References Cited

U.S. PATENT DOCUMENTS

| | | | |
|---|---|---|---|
| 3,150,715 | 9/1964 | Dietz | 166/261 |
| 3,978,925 | 9/1976 | Redford | 166/261 |
| 3,991,828 | 11/1976 | Allen et al. | 166/261 |
| 4,006,778 | 2/1977 | Redford et al. | 166/261 |
| 4,024,915 | 5/1977 | Allen | 166/261 X |

*Primary Examiner*—Stephen J. Novosad

*Attorney, Agent, or Firm*—Thomas H. Whaley; Carl G. Ries; Charles L. Bauer

[57] ABSTRACT

An improved method for the recovery of heavy oils and bitumen from subterranean formations by the injection thereinto of a mixture of an oxygen-containing gas and steam in which the ratio of free oxygen in the gas to steam is in the range of 0.03 to 0.13 MSCF/bbl.

15 Claims, 2 Drawing Figures

BITUMEN RECOVERY (%) VS AIR/STEAM RATIO (MSCF/BBL) FOR SEVERAL AIR/STEAM RUNS

BITUMEN RECOVERY (%) VS AIR/STEAM RATIO (MSCF/BBL) AT 2 PV STEAM INJECTED

BITUMEN RECOVERY (%) VS AIR/STEAM RATIO (MSCF/BBL) FOR SEVERAL AIR/STEAM RUNS

LOW-TEMPERATURE OXIDATION METHOD FOR THE RECOVERY OF HEAVY OILS AND BITUMEN

BACKGROUND OF THE INVENTION

This invention relates to an improved method for the recovery of oil from subterranean hydrocarbon-bearing formations containing low API gravity, viscous oils or bitumen. More particularly, the invention relates to the production of low-mobility hydrocarbons or bitumen from tar sands utilizing a low-temperature oxidation technique.

The recovery of viscous oils from formations and bitumen from tar sands has generally been difficult. Although some improvement has been realized in stimulating recovery of heavy oils, i.e., oils having an API gravity in the range of 10° to 25° API, little, if any, success has been realized in recovering bitumen from tar sands. Bitumen can be regarded as highly viscous oils having a gravity in the range of about 5° to 10° API and contained in an essentially unconsolidated sand referred to as tar sands.

Vast quantities of tar sands exist in the Athabasca region of Alberta, Canada. While these deposits are estimated to contain over seven hundred billion barrels of oil or bitumen, in-situ recovery therefrom using conventional techniques has not been too successful. The reasons for the lack of success relate principally to the fact that bitumen is extremely viscous at the temperature of the formation, with consequent low mobility. In addition, these tar sand formations have very low permeability, despite the fact they are unconsolidated.

Since it is known that the viscosity of oil decreases markedly with an increase in temperature, thereby improving the mobility of the oil, thermal recovery techniques have been investigated for recovery of bitumen from tar sands. These thermal recovery methods generally include steam injection, hot water injection and in-situ combustion, and the general techniques in employing these methods are well-known in the prior art.

In addition, variations and improvements in the basic techniques are described in the prior art, such as the "huff and puff" method utilizing steam, and the reverse in-situ combustion technique. Improvements have also been set forth in the in-situ combustion method that employ the use of water injection, either simultaneously or intermittently with the air or oxygen-containing gas, to scavenge the residual heat in the formation and also to improve the conformance and sweep efficiency.

Experience has generally shown that these conventional thermal techniques have not been altogether successful when applied to the in-situ recovery of heavy oils. Difficulties have included the build-up of an excessive oil bank ahead of the thermal front that results in plugging of the formation ahead of the front and hence loss of injectivity into the formation. Furthermore, in the case of in-situ combustion as applied to the recovery of heavy oils which contain high percentages of heavy ends, excessive carbonization occurs with a consequent progressive decrease in the rate of movement of the combustion front and the eventual extinguishment of the combustion.

The difficulties become compounded when these techniques are applied to the recovery of bitumen from tar sands since bitumen has a lower API gravity, i.e., 5° to 10° API, and a higher viscosity, i.e., in the millions of centipoises, as compared with heavy oils. In addition, the permeability of the tar sands is so low that difficulty has been experienced in establishing fluid communication within the formation.

Still later developments utilizing thermal methods for the recovery of viscous oils and in particular bitumen from tar sands have sought to overcome the above-recited difficulties. Recent developments relate to the low-temperature oxidation process whreby the temperatures attained in the formation are controlled and maintained well-below those temperatures reached in the conventional in-situ combustion process. In the low-temperature oxidation process, such as that taught in U.S. Pat. No. 4,006,778, issued Feb. 8, 1977, a mixture of an oxygen-containing gas and steam is injected wherein the temperature of the injected mixture corresponds to the temperature of saturated steam at the pressure of the formation. A low-temperature oxidation is caused to occur in the formation whereby the temperature in the formation is raised to the temperature of the injected saturated steam. Preferably this temperature is in the range of 250° to 500° F. Control of the temperature is accomplished by the presence of the saturated steam, that is, by the presence of a liquid water phase. With the rise in temperature, improved mobility of the bitumen, with minimum carbonization, is effected, so that the bitumen can be displaced through th formation toward a production well from which it is produced. The continued injection of the mixture of the oxygen-containing gas and steam provides the displacement means.

Prior art also teaches modifications in the low-temperature oxidation process such as set forth in U.S. Pat. No. 3,978,925 which issued Sept. 7, 1976, wherein a soak period is provided by shutting in the injection and production wells for a period of time to permit the injected oxygen to be consumed in the low-temperature oxidation reaction with hydrocarbons within the formation. Further, U.S. Pat. No. 3,993,132 which issued Nov. 23, 1976, teaches using an optimum gas to steam ratio in the low-temperature oxidation process, which ratio is decreased as the cumulative amount of steam is increased. In yet another development as set forth in U.S. Pat. No. 3,976,137 which issued Aug. 24, 1976, employing the low-temperature oxidation process, the use of a ratio of oxygen to steam in the range of 200 to 800 standard cubic feet of oxygen per barrel of steam (SCF/bbl) or 0.20 to 0.80 MSCF/bbl is taught.

The instant invention discloses an improvement in the low-temperature oxidation process whereby the recovery efficiency is improved by utilizing and maintaining the ratio of the free oxygen in the oxygen-containing gas to the steam at very low ratios.

SUMMARY OF THE INVENTION

This invention relates to the recovery of low API gravity, viscous oils and bitumen from tar sands by the use of a low-temperature oxidation, by the injection of a mixture of an oxygn-containing gas and steam at a temperature corresponding to the temperature of saturated steam at the pressure of the formation wherein the free oxygen in the oxygen-containing gas to the steam is maintained in the range of 0.03 to 0.13 MSCF/bbl.

DESCRIPTION OF THE PREFERRED EMBODIMENT

Figure 1:
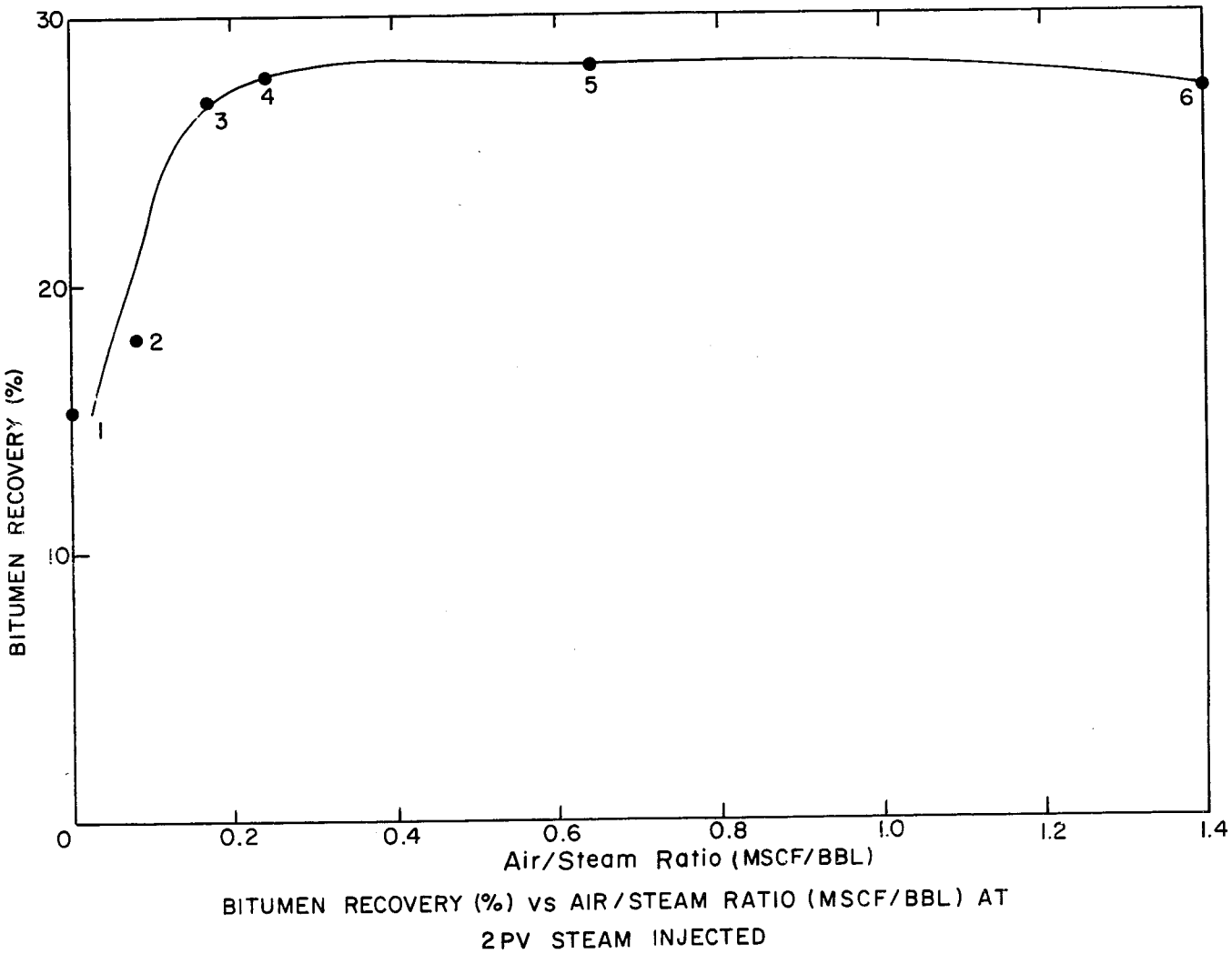
FIG. 1 shows the relationship between the air/steam ratio at 2 pore volumes steam injected and bitumen recovery.

We have now found that, in the method of the recovery of heavy crudes and bitumen utilizing the injection of an oxygen-containing gas and steam, the recovery efficiency can be optimized by utilizing and maintaining the ratio of the free oxygen in the oxygen-containing gas to steam at a low ratio and in a range of about 0.03 to 0.13 MSCF/bbl.

In a broad aspect of the invention, a hydrocarbon-bearing formation, as, for example, a tar sand containing bitumen, is first traversed by at least one injection well and one production well. Thereafter, fluid communication between the wells is established, for example, by the injection of non-condensible gas, a solvent or steam. Fracturing may also be employed to improve the transmissibility of the formation. Once communication is established in the formation, a mixture of an oxygen-containing gas and steam is injected, such mixture being injected at a temperature corresponding to the temperature of saturated steam at the pressure of the formation to effect a low-temperature oxidation in the formation. Preferably, the temperature is in the range of from about 250° to about 500° F. By using saturated steam at a temperature corresponding to the temperature of saturated steam at the pressure of the formation, effective control of the temperature rise in the formation is maintained. By saturated steam is meant steam having a liquid water phase present or in other terms having a quality less than 100%. Steam quality is defined as the weight percent of dry steam contained in one pound of wet steam.

In the improvement comprising the instant invention, a ratio of the free oxygen in the oxygen-containing gas to steam is utilized and maintained at a low value in the range of 0.03 to 0.13 MSCF of oxygn per barrel of steam (measured as liquid water). Within the scope of this invention, an "oxygen-containing gas" means a gas that contains free oxygen gas as a component. While the most common oxygen-containing gas is air, it is within the scope of the invention to use a gas enriched with oxygen or substantially pure oxygen. The gas may also be a mixture of oxygen and other non-condensible gases as nitrogen, carbon dioxide and flue gas.

In the practice of the invention using air, the desired gas to steam ratio may be expressed in terms of standard cubic feet air to barrels of steam. Thus the desired ratio of 0.03 to 0.13 MSCF $O_2$/bbl steam would be about 0.15 to 0.65 MSCF of air per barrel of steam. As taught in U.S. Patent 4,006,778, the saturated steam may have a quality up to 100%, although comparable recovery has been obtained using steam with a quality of 60%.

While the preferred temperature range is 250° to 500° F. this temperture range may be realized by adjusting the pressure of the formation to a pressure corresponding to that temperature of saturated steam in the desired temperature range. For example, a formation having a pressure below 300 psi may be repressured to about 300 psi so that the temperature of the injected mixture of oxygen-containing gas and steam would be approximately 420° F. Repressuring may be accomplished by the injection of gas and/or the injection of water, during which times the formation would not be produced.

To illustrate the invention, a series of laboratory runs was performed using a tar sand from the McMurray formation in Alberta, Canada. A laboratory cell approximately 15 inches long and 18 inches in diameter was packed with from 170 to 190 pounds of tar sand. Generally, a communications path consisting of clean 20–40 fracturing sand was provided between the wells during its packing. The cell was equipped for operating at controlled temperatures up to about 420° F. and pressures up to about 300 psi and contained simulated suitable injection and production wells. The cell was also equipped with many thermocouples so that both temperatures throughout the cell could be measured and heat transfer rates could be calculated. The injection system was provided with a manifold allowing for the injection of separate streams of fluid as, for example, steam and air which could be mixed at the injection well. Th producing system was provided with the necessary control and measurement instrumentation to monitor and analyze the produced fluids. Porosity of the tar sand pack was determined from the equation $$\phi = 1 - (\rho_{bs}/2.65)(1 - w_{fb} - w_{fw})$$

where $\rho_{bs}$ is the density of the tar sand and $w_{fb}$ and $w_{fw}$ are the weight fractions of bitumen and water, respectively. By knowing the porosity, quantities of fluids injected and produced could therefore be expressed in terms of pore volumes (PV).

In a typical run generally a preliminary injection period was conducted wherein either air or steam was injected for a short period of time to insure that fluid communication between the wells was present. Thereafter a mixture of an oxygen-containing gas and steam was injected in which the ratio of the free oxygen in the oxygen-containing gas to the steam was known and controlled. The ratio is expressed in terms of thousand cubic feet of oxygen per barrel of steam, measured as liquid water (MSCF/bbl). Low-temperature oxidation was established in the formation at a temperature of about 417°, corresponding to the temperature of the injected saturated steam. In the runs described herein injection of the mixture of the oxygen-containing gas and steam was continued until a desired cumulative pore volume of steam had been injected. In some runs as much as 4 pore volumes of steam was injected. The attached table shows the results, tabulated in terms of cumulative recovery and cumulative oxygen/steam and air/steam ratio and pore volumes of steam injected.

A straight steam run (Run 1) has been included for comparison with runs utilizing a mixture of an oxygen-containing gas (air) and steam. The results demonstrate that the use of a mixture of air and steam yield increased recovery of bitumen as compared with using steam only. The results showed that at 2 pore volumes of injected steam, maximum bitumen recovery is realized when the cumulative air to steam ratio is in the range of about 0.15 to about 0.65 MSCF of air per barrel of steam or 0.03 to about 0.13 MSCF oxygen per barrel of steam. Furthermore, with the cumulative recovery measured at the termination of the run it may be seen that the highest recovery occurred when the cumulative air-to-steam ratio was in the range of 0.17 to 0.25 MSCF/bbl or about 0.035 to 0.050 MSCF oxygen per barrel of steam.

Figure 2:
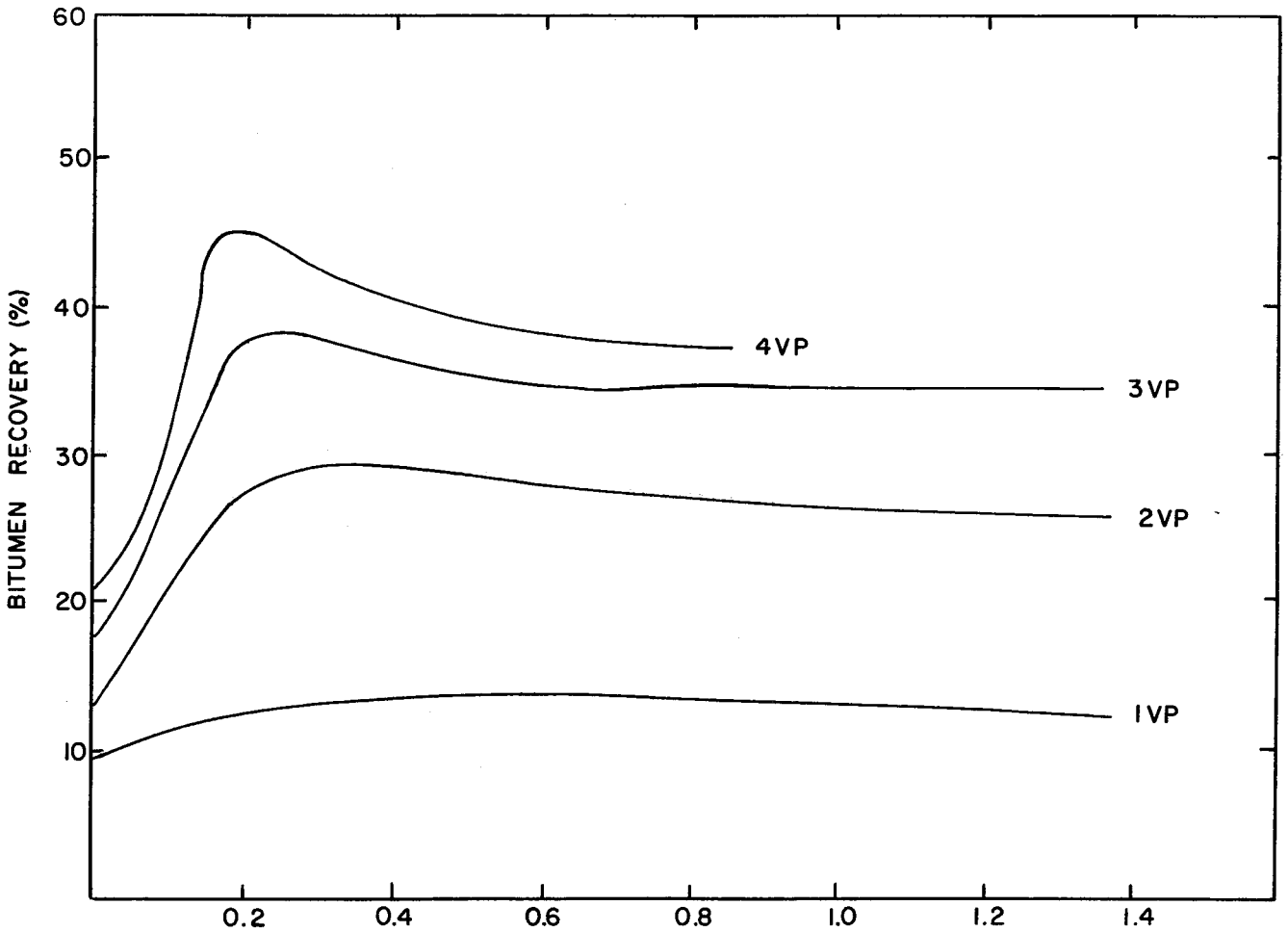
FIG. 2 shows the relationship between the air/steam ratio and bitumen recovery for given pore volumes of steam injected.

In the attached table the results of Run 6 show that the cumulative bitumen recovery at both 2 pore volumes and termination pore volumes of injected steam were comparable to the recoveries from the other runs. It is seen that Run 6 had a much higher air/steam ratio, namely 1.4 MSCF per barrel at 2 pore volumes. Considerable difficulty was experienced during this run caused by plugging and excessive carbonization of the bitumen, manifested by a gradual decrease of the injectivity of the fluid mixture. Numerous necessary remedial measures were taken in an effort to continue the run, so that results could be obtained at higher pore volumes of injected steam. These measures included reversing the flow and adjusting injection rates. Nevertheless, the highr ratio could not be maintained and decreased during the run. The results indicate clearly that at too high an air/steam ratio, operational difficulties may be experienced. Consequently, too high an air/steam ratio is undesirable.

the results are also plotted in FIGS. 1 and 2. In FIG. 1 bitumen recovery is plotted vs. the air/steam ratio (MSCF per barrel) at 2 pore volumes injected steam. The results indicate a significant increase in recovery occurs after a ratio of about 0.15 MSCF air per barrel of steam has been realized. In FIG. 2 bitumen recovery is plotted vs. air/steam ratio (MSCF per barrel) for given pore volumes of injected steam. The results again indicate that maximum recovery is obtained after about 0.15 MSCF air per barrel of steam has been realized, and further show that maximum recovery is obtained when the air/steam ratio is in the range of 0.15 to 0.65 MSCF/bbl.

TABLE 1

OIL RECOVERY AND CUMULATIVE FREE $O_2$/STEAM RATIO AT GIVEN INJECTED PORE VOLUMES (PV) OF STEAM

| | | 2 PV STEAM | | | 4 PV STEAM | | | AT TERMINATION OF RUN | | |
|---|---|---|---|---|---|---|---|---|---|---|
| RUN | FLUIDS INJECTED | Cum Free-$O_2$/ Steam (MSCF/ bbl) | Cum Air/ Steam (MSCF/ bbl) | Cum Recovery (%OOIP) | Cum Free-$O_2$/ Steam (MSCF/ bbl) | Cum Air/ Steam (MSCF/ bbl) | Cum Recovery (%OOIP) | Cum Free-$O_2$/ Steam (MSCF/ bbl) | Cum Air/ Steam (MSCF/ bbl) | Cum Recovery (%OOIP) |
| 1 | Steam | 0 | 0 | 15.2 | 0 | 0 | 21.2 | 0 | 0 | 31.4 |
| 2 | Air/Steam | 0.016 | 0.08 | 18.0 | 0.022 | 0.11 | 26.2 | 0.030 | 0.15 | 35.2 |
| 3 | Air/Steam | 0.034 | 0.17 | 26.8 | 0.036 | 0.18 | 46.4 | 0.034 | 0.17 | 62.3 |
| 4(1) | Air/Steam | 0.048 | 0.24 | 27.7 | 0.052 | 0.26 | 42.4 | 0.048 | 0.24 | 46.7 |
| 5(2) | Air/Steam | 0.128 | 0.64 | 28.0 | 0.130 | 0.65 | 37.4 | 0.132 | 0.66 | 39.2 |
| 6(2) | Air/Steam | 0.280 | 1.40 | 27.1 | 0.148 | 0.74 | 39.5 | 0.130 | 0.65 | 40.6 |

(1)Air injected briefly prior to injection of Air/Steam mixture.
(2)Steam injected briefly prior to injection of Air/Steam mixture.

It is postulated that in the low-temperature oxidation process the oxygen combines with the bitumen to form various oxidation products such as aldehydes, ketones and acid. Furthermore, the temperature of this low-temperature oxidation process is controlled by the performance of the liquid water phase and the saturated steam so that the temperature is controlled and maintained below about 500° F. The improved performance over that when steam only is injected may be attributed to better distribution of the heat generated by the low-temperature oxidation process and to the creation of flow channels with minimum formation of carbonized portions of the bitumen. An important element of the process is that liquid water must be present to absorb the heat of oxidation so as to control the temperature and improve the heat distribution. Without this water present, uncontrolled combustion of the bitumen could occur that would result in heavy deposition of carbonized bitumen and subsequent plugging of the formation.

The importance of controlling the air/steam ratio and the use of low ratios may be demonstrated by the following calculations relating to heat generation. The heats released by the low-temperature oxidation reactions per mol of oxygen when produced water is in the liquid phase, are as follows:

Carboxylation or formation of $CO_2$; 105 kcal/mol $O_2$
Carboxylation or formation of CO; 90 kcal/mol $O_2$
Hydroxylation; 90 kcal/mol $O_2$
Hydroperoxidation; 30 kcal/mol $O_2$ For the purposes of an approximate calculation, an average heat release may be assumed to be 95 kcal/mol $O_2$. At an air/steam ratio of 0.2 MSCF/bbl., and assuming all the injected oxygen is utilized, the relative heats generated by the oxidation of bitumen and by the condensation of steam would be:

| Heat of oxidation: | | | | | | | | | | |
|---|---|---|---|---|---|---|---|---|---|---|
| 200 (SCF air) | × | 0.21 ($O_2$ content) (of air) | × | 1.195 (mol/SCF) | × | 95 (kcal/mol) $O_2$ | × | 4.19 (kjoule/kcal) | × | 0.94 = 18.9 MBTU (BTU/kjoule) |

| Latent heat of steam at 300 psig: | | | | |
|---|---|---|---|---|
| 1 (bbl. steam) | × | 350 (lb./bbl.) | × | 805.9 = 282.1 MBTU (BTU/lb.) |

Thus, at an air/steam ratio of 0.2 MSCF/bbl., the heat contribution of th oxidation processes will be some 6.7% of the latent heat of steam. At an air/steam ratio of 0.60 MSCF/bbl., this contribution would rise to 20%. Also, if the steam injected is less than 100% quality, the relative contribution due to oxidation will be somewhat higher. It is concluded that the heat contribution provided by the oxidation reactions is a significant factor in the low-temperature oxidation process.

In summary, in accordance with the invention, improved recovery of heavy oils or bitumen is accomplished by the injection of a mixture of an oxygen-containing gas and steam within the ratio of the free oxygen and the oxygen-containing gas to steam is maintained in the range of 0.03 to about 0.13 MSCF oxygen per barrel steam or in a situation where air is the oxygen-containing gas, a rate of about 0.15 to about 0.65 MSCF air/bbl. steam.

We claim:

1. In a method for the recovery of hydrocarbons from a subterranean tar sand formation traversed by at least one injection well and at least one production well, and having fluid communication therebetween, wherein a mixture of steam having a quality less than 100% and an oxygen-containing gas is injected via said injection well, said mixture being at the temperature correpsonding to the temperature of saturated steam at the pressure of said formation, and fluids are produced via said production well, the improvement comprising maintaining the ratio of the free oxygen in the oxygen-containing gas to the steam in the range of about 0.03 to 0.130 MSCF of oxygen per barrel of steam, measured as water.

2. The method of claim 1 wherein said oxygen-containing gas is substantially pure oxygen.

3. The method of claim 1 wherein said oxygen-containing gas is air.

4. The method of claim 1 wherein the oxygen-containing gas comprises oxygen and nitrogen, carbon dioxide, flue gas and mixtures thereof.

5. The method of claim 1 wherein said formation is first repressured to a pressure corresponding to a temperature of saturated steam in the range of 250° F. to 500° F.

6. The method of claim 1 wherein said mixture of an oxygen-containing gas and steam is injected at a temperature in the range of 250° F. to 500° F.

7. the method of claim 1 wherein a non-condensible gas is injected into said formation prior to the injection of the mixture of an oxygen-containing gas and steam.

8. The method of claim 7 wherein said non-condensible gas is air, nitrogen, carbon dioxide, flue gas and mixtures thererof.

9. The method of claim 7 wherein steam is injected into said formation prior to the injection of the mixture of an oxygen-containing gas and steam.

10. In a method for the recovery of bitumen from a tar sand formation traversed by at least one injection well and at least one production well wherein a mixture of steam having a quality of not more than 100% and air is injected via said injection well, said mixture being at the temperature corresponding to the temperature of saturated steam at the pressure of said formation, to effect a low-temperature oxidation of a portion of the bitumen in said formation, and fluids are produced via said production well, the improvement comprising maintaining the ratio of air-to-steam in the range of 0.15 to 0.65 MSCF of air per barrel of steam, measured as water.

11. The method of claim 10 wherein said formation is first repressured to a pressure corresponding to a temperature of saturated steam in the range of 250° F. to 500° F.

12. The method of claim 10 wherein said mixture of air and steam is injected at a temperature in the range of 250° F. to 500° F.

13. The method of claim 10 wherein a non-condensible gas is injected into said formation prior to the injection of the mixture of air and steam.

14. The method of claim 10 wherein steam is injected into said formation prior to the injection of the mixture of air and steam.

15. The method of claim 10 wherein the ratio of air to the steam is in the range of about 0.17 to 0.25 MSCF/barrel of steam, measured as water.

* * * * *